US006532654B2

(12) United States Patent
Guerin et al.

(10) Patent No.: US 6,532,654 B2
(45) Date of Patent: Mar. 18, 2003

(54) METHOD OF FORMING AN ELECTRICAL CONNECTOR

(75) Inventors: Luc Gilbert Guerin, Quebec (CA); Mario J. Interrante, New Paltz, NY (US); Mark Joseph LaPlante, Montgomery, NY (US); David Clifford Long, Wappingers Falls, NY (US); Gregory Blair Martin, Wappingers Falls, NY (US); Thomas P. Moyer, Lagrangeville, NY (US); Glenn A. Pomerantz, Kerhonkson, NY (US); Thomas Weiss, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 111 days.

(21) Appl. No.: 09/759,014

(22) Filed: Jan. 12, 2001

(65) Prior Publication Data

US 2002/0092164 A1 Jul. 18, 2002

(51) Int. Cl.[7] ..... H01R 43/00

(52) U.S. Cl. ..... 29/884; 29/874; 29/877; 439/66; 439/78; 439/608; 361/760; 361/772

(58) Field of Search ..... 29/877, 884, 747, 29/825, 829, 843, 745, 753, 874, 882, 885; 439/65, 66, 78, 608, 609, 610, 733.1, 744, 83, 931, 84; 361/760, 772, 776, 771

(56) References Cited

U.S. PATENT DOCUMENTS 4,370,012 A * 1/1983 Grabbe et al.
5,139,427 A 8/1992 Boyd et al.
5,173,055 A 12/1992 Grabbe
5,299,939 A 4/1994 Walker et al.
5,343,616 A 9/1994 Roberts ..... 29/846
5,624,268 A * 4/1997 Maeda et al. ..... 439/66
5,632,629 A * 5/1997 Legrady ..... 439/78
5,730,608 A * 3/1998 Legrady ..... 439/78
5,774,987 A * 7/1998 Chadbourne et al.
5,812,378 A * 9/1998 Fjelstad et al.
5,832,601 A * 11/1998 Eldridge et al. ..... 29/843
5,967,797 A * 10/1999 Maldonado ..... 439/66
6,000,975 A * 12/1999 Feldman
6,032,356 A * 3/2000 Eldridge et al. ..... 29/843
6,045,367 A * 4/2000 Maldonado ..... 439/66
6,050,863 A * 4/2000 Noda
6,066,010 A * 5/2000 Wulff
6,139,362 A * 10/2000 Brown
6,184,587 B1 * 2/2001 Khandros et al. ..... 361/776 X
6,186,799 B1 * 2/2001 Mello
6,188,028 B1 * 2/2001 Haba et al. ..... 439/66 X

* cited by examiner

*Primary Examiner*—Ljiljana Ciric
(74) *Attorney, Agent, or Firm*—Ira D. Blecker

(57) ABSTRACT

A method of forming an electrical connector including providing a metallic sheet having a multitude of connector blanks formed therein, each of the connector blanks having a base portion, a contact portion and a singulation arm; forming each of the connector blanks into a connector having a predetermined shape wherein each of the connectors remain connected to the metallic sheet by their respective singulation arms and wherein the singulation arms are nonplanar with respect to the metallic sheet; joining the base of each of the connectors to a first substrate; and severing the singulation arms to separate each of the connectors from the metallic sheet wherein the base of each of the connectors is joined to the first substrate. In a preferred embodiment, the contact portion contacts a second substrate.

24 Claims, 6 Drawing Sheets

METHOD OF FORMING AN ELECTRICAL CONNECTOR

BACKGROUND OF THE INVENTION

The present invention relates to the field of electrical connection and, more particularly, a method of forming an electrical connector onto a substrate.

Various techniques exist in the prior art for making electrical connections between electronic components. These techniques typically use solder ball or solder column connections, wire bond pads or pins, or flexible connector arrangements. Thermal cycling fatigue limitations further limit the size of substrate that can be used for solder ball or solder column connections. Solder ball and solder column connections also have limitations because of the amount of space they require.

Pin arrangements, likewise, have space limitations. For example, the connectors to which the pins are attached utilize metal compression bits as pin sockets. Such structure, in itself, requires a relatively large amount of space and additional space must also be allocated for the flexing movement upon pin insertion. Moreover, these pin sockets are typically soldered into the next level of assembly, using additional space for holes and/or surface lands.

Flexible connectors are a viable option but there are difficulties inherent in such connectors. First, such flexible connectors are susceptible to fatigue. Second, each flexible connector must be individually connected to the substrate, thereby making manufacturability and cost an issue.

In addition to the connectors described above, various other connector techniques have been developed for connecting electronic components.

Boyd et al. U.S. Pat. No. 5,139,427, the disclosure of which is incorporated by reference herein, discloses a connector array in which individual connector elements are formed from sheet stock and then individually loaded into and captured by an insulating spacer.

Grabbe U.S. Pat. No. 5,173,055, the disclosure of which is incorporated by reference herein, discloses an area array connector in which connector elements are formed in a metallic sheet, laminated to a nonmetallic sheet, punched to isolate the connector elements and then joined to a substrate. The nonmetallic sheet is then removed to leave the individual connector elements.

Walker et al. U.S. Pat. No. 5,299,939, the disclosure of which is incorporated by reference herein, discloses an array of spring connectors which are formed by deposition and photoetch processes.

Roberts U.S. Pat. No. 5,343,616, the disclosure of which is incorporated by reference herein, discloses the formation of a conductive network wherein a metal sheet is coined to form ridges and then is glued to an insulator. Portions of the metal sheet are then ground away to isolate portions of the metal sheet which form contacts.

In view of the above, it is purpose of the present invention to have an electrical connector that is formed in an array and easily attached to a substrate.

It is another purpose of the present invention to have an electrical connector attached to a substrate that is manufacturable and relatively modest in cost.

These and other purposes of the present invention will become more apparent after referring to the following description considered in conjunction with the accompanying drawings.

BRIEF SUMMARY OF THE INVENTION

The purposes of the invention have been achieved by providing, according to a first aspect of the invention, a method of forming an electrical connector comprising:

providing a metallic sheet having a plurality of connector blanks formed therein, each of the connector blanks having a base portion, a contact portion and a singulation arm;

forming each of the connector blanks into a connector having a predetermined shape wherein each of the connectors remain connected to the metallic sheet by their respective singulation arms and wherein the singulation arms are nonplanar with respect to the metallic sheet;

joining the base of each of the connectors to a first substrate; and severing the singulation arms to separate each of the connectors from the metallic sheet wherein the base of each of the connectors is joined to the first substrate and the contact portion is adapted for contacting a second substrate.

According to a second aspect of the invention, there is provided a method of forming an electrical connector comprising:

providing a first metallic sheet having a plurality of connector blanks formed therein, each of the connector blanks having a base portion, a contact portion and a singulation arm;

forming each of the connector blanks of the first metallic sheet into a connector having a predetermined shape wherein each of the connectors remain connected to the first metallic sheet by their respective singulation arms, the metallic sheet having a perforation at least as large as the base portion of the connectors adjacent to each of the connectors;

providing a second metallic sheet having a plurality of connector blanks formed therein, each of the connector blanks having a base portion, a contact portion and a singulation arm;

forming each of the connector blanks of the second metallic sheet into a connector having a predetermined shape wherein each of the connectors remain connected to the second metallic sheet by their respective singulation arms, the metallic sheet having a perforation at least as large as the base portion of the connectors adjacent to each of the connectors;

placing the first and second metallic sheets together so that each connector of one of the metallic sheets fits into the perforation adjacent to each of the connectors of the other of the metallic sheets;

joining the base of each of the connectors to a first substrate; and severing the singulation arms to separate each of the connectors from the metallic sheet wherein the base of each of the connectors is joined to the first substrate and the contact portion is adapted for contacting a second substrate.

According to a third aspect of the invention, there is provided a method of forming an electrical connector comprising:

providing a metallic sheet having a plurality of connector blanks formed therein, each of the connector blanks having a base portion, a contact portion and a singulation arm;

forming each of the connector blanks into a connector having a predetermined shape wherein each of the connectors remain connected to the metallic sheet by their respective singulation arms and wherein the singulation arms are nonplanar with respect to the metallic sheet;

joining the base of each of the connectors to a first substrate;

severing the singulation arms to separate each of the connectors from the metallic sheet wherein the base of each of the connectors is joined to the first substrate; and placing a second substrate adjacent to the first substrate so that each of the contact portions of the connectors contacts the second substrate.

According to a fourth aspect of the invention, there is provided a method of forming an electrical connector comprising:

providing a first metallic sheet having a plurality of connector blanks formed therein, each of the connector blanks having a base portion, a contact portion and a singulation arm;

forming each of the connector blanks of the first metallic sheet into a connector having a predetermined shape wherein each of the connectors remain connected to the first metallic sheet by their respective singulation arms, the metallic sheet having a perforation at least as large as the base portion of the connectors adjacent to each of the connectors;

providing a second metallic sheet having a plurality of connector blanks formed therein, each of the connector blanks having a base portion, a contact portion and a singulation arm;

forming each of the connector blanks of the second metallic sheet into a connector having a predetermined shape wherein each of the connectors remain connected to the second metallic sheet by their respective singulation arms, the metallic sheet having a perforation at least as large as the base portion of the connectors adjacent to each of the connectors;

placing the first and second metallic sheets together so that each connector of one of the metallic sheets fits into the perforation adjacent to each of the connectors of the other of the metallic sheets;

joining the base of each of the connectors to a first substrate;

severing the singulation arms to separate each of the connectors from the metallic sheet wherein the base of each of the connectors is joined to the first substrate; and placing a second substrate adjacent to the first substrate so that each of the contact portions of the connectors contacts the second substrate.

BRIEF DESCRIPTION OF THE DRAWINGS

The features of the invention believed to be novel and the elements characteristic of the invention are set forth with particularity in the appended claims. The Figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

The present invention is particularly suitable for making a plurality of connectors and joining them simultaneously to a substrate. Since these connectors are very small, on the order of 1 to 2 mm., it is difficult to handle them as well as join them to a substrate. The present invention alleviates the manufacturability problems of the prior art by forming the connectors from a sheet of metallic material, joining them to a substrate and then singulating them (i.e., separating the individual connectors from the sheet).

Figure 1:
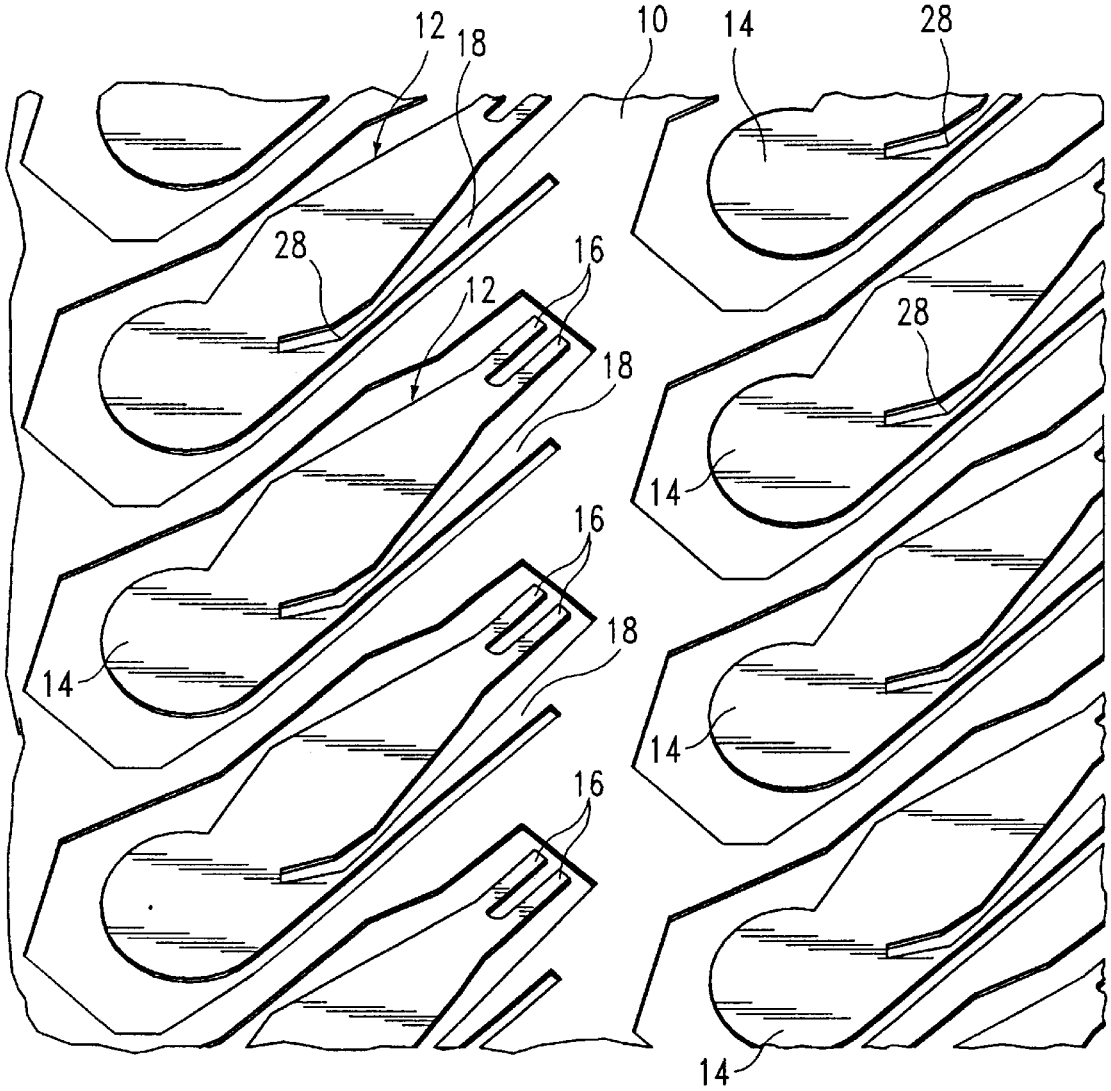
FIG. 1 is a view of a sheet having a plurality of connector blanks formed therein.

Referring to the Figures in more detail, and particularly referring to FIG. 1, there is shown a metallic sheet 10 having a plurality of connector blanks, generally indicated by 12, formed therein. Each of the connector blanks 12 includes a base portion 14, a contact portion 16 and a singulating arm 18.

The metallic sheet may be made from any material that is suitable for use as a connector. Such materials include, for purposes of illustration and not limitation, copper, beryllium copper, brass, bronze, steel, nickel, titanium and nickel titanium alloys. The material must also possess, or be capable of possessing, a certain springiness so that the connector makes and maintains contact with a mating pad or surface without being permanently deformed.

The shape of the connector blanks 12 may be made by any number of manufacturing processes including laser ablation, chemical etching, photolithography, mechanical punching, water jet cutting, electrodischarge machining (EDM), and blanking, just to name a few. Due to the small sizes of the connectors that are contemplated within the scope of the present invention, mechanical processes such as stamping probably would be difficult. However, it is also contemplated within the scope of the present invention that the connectors could be made larger, in which case mechanical processes would be satisfactory.

Figure 2:
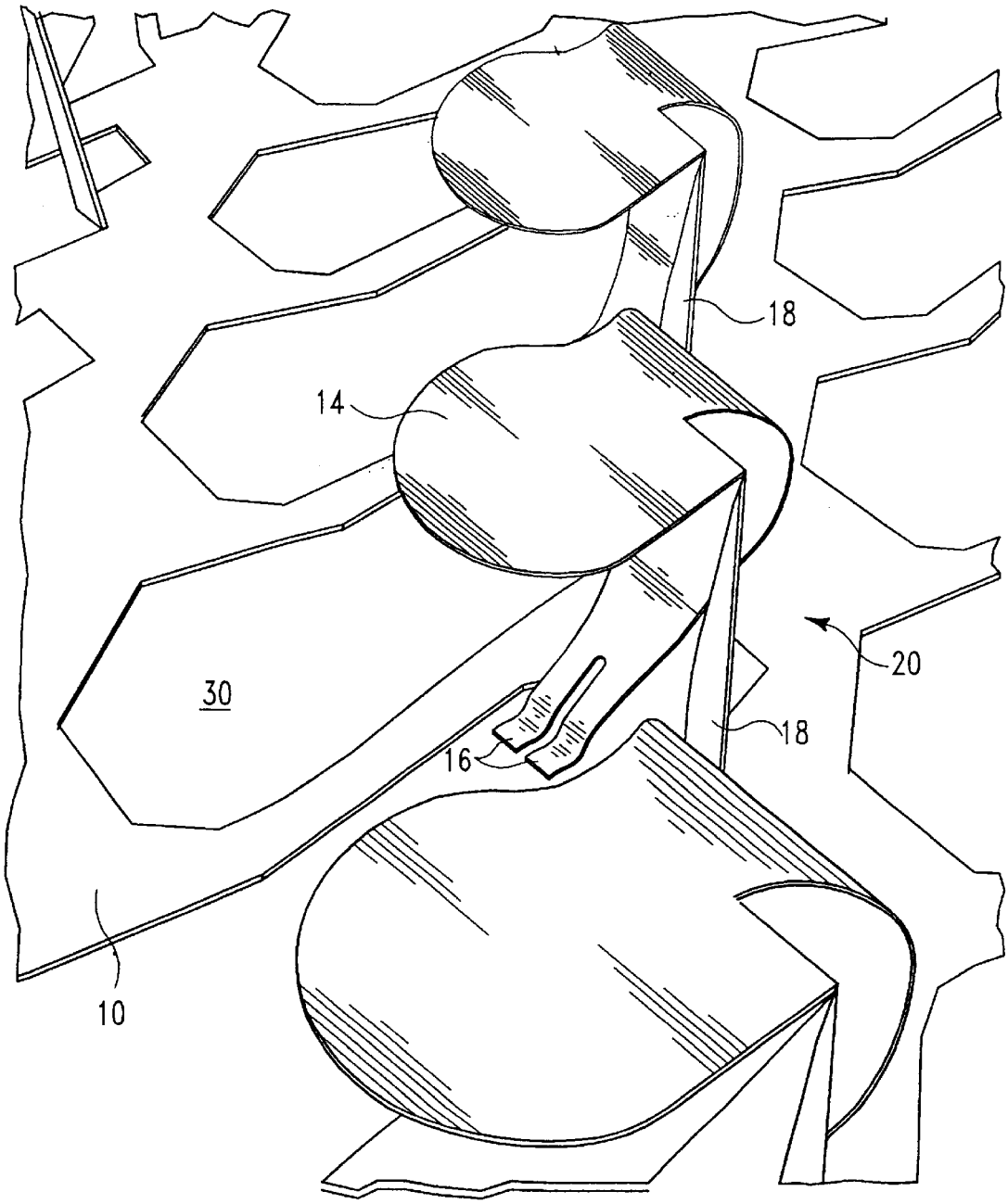
FIG. 2 is a perspective view of the sheet of FIG. 1 after the connector blanks have been formed into connectors.
Figure 4:
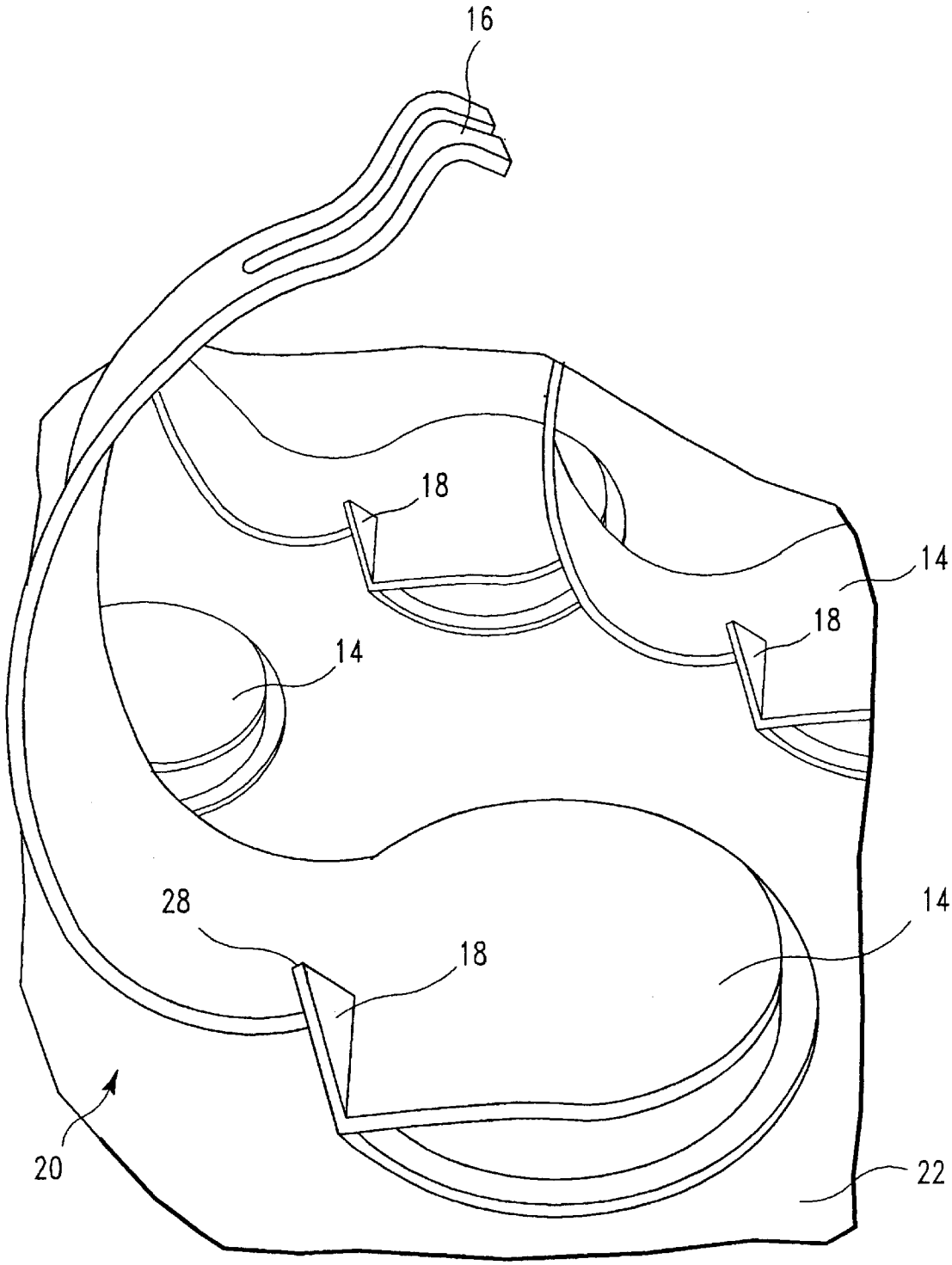
FIG. 4 is a perspective view of the connectors of FIG. 3 after being singulated.

Referring now to FIG. 4, the connector blanks 12 as shown in FIG. 1 are formed into the connectors 20 shown in FIG. 4 which remain attached to the metallic sheet 10 by singulation arms 18. As can be seen, the singulation arms 18 are nonplanar with respect to the metallic sheet 10. That is, the singulation arms 18 are not in the same plane as the metallic sheet 10 and, preferably, are approximately perpendicular to the metallic sheet 10 as shown in FIG. 2. The forming and bending of the connectors 20 may be done by mechanical processes which are well known to those skilled in the art.

Figure 3:
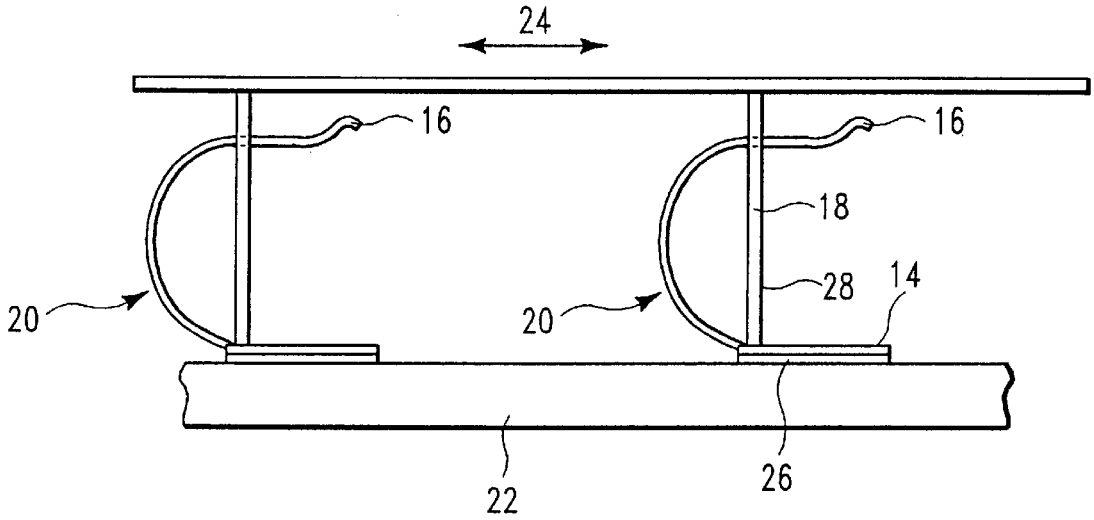
FIG. 3 is a side view of the sheet of FIG. 2 after the connectors have been joined to a substrate.

After forming of the connectors 20, in one preferred embodiment the metallic sheet 10 with the plurality of connectors 20 is inverted and joined to a substrate 22. As can be seen in FIG. 3, the base 14 of each of the connectors 20 is joined by a material (not shown) such as solder, conductive epoxy or similar material, or a mechanical process (not shown) such as welding, ultrasonic welding, staking, riveting, or similar process, to a pad 26 on the substrate 22. Contact portion 16 of each of the connectors 20 is not connected. Again, singulation arms 18 maintain the holding relationship between the connectors 20 and metallic sheet 10.

The singulation arms 18 are severed to separate each of the connectors 20 from the metallic sheet 10. A preferred method of severing the singulation arms 18 is by moving the metallic sheet 10 back and forth, as indicated by arrows 24, to induce fatigue in the singulation arms 18. In a preferred embodiment of the present invention, a stress point 28 is designed into the singulation arms 18 to initiate early fatigue. The singulation arms 18 may be severed by other methods, including rotation of metallic sheet 10, laser deletion, oscillatory vibration, shearing or tensile pulling. A further preferred embodiment of the present invention has the stress point 28 with different mechanical properties. Most preferred would have the stress point 28 embrittled such that deformation beyond its yield point causes it to break off. This embrittlement can be achieved by work hardening or local heat treating such as with a laser.

Referring now to FIG. 4, the plurality of connectors 20 are shown separated from metallic sheet 10. Only a nub of singulation arm 18 is left at each connector 20 where the singulation arm broke off at stress point 28.

Figure 5:
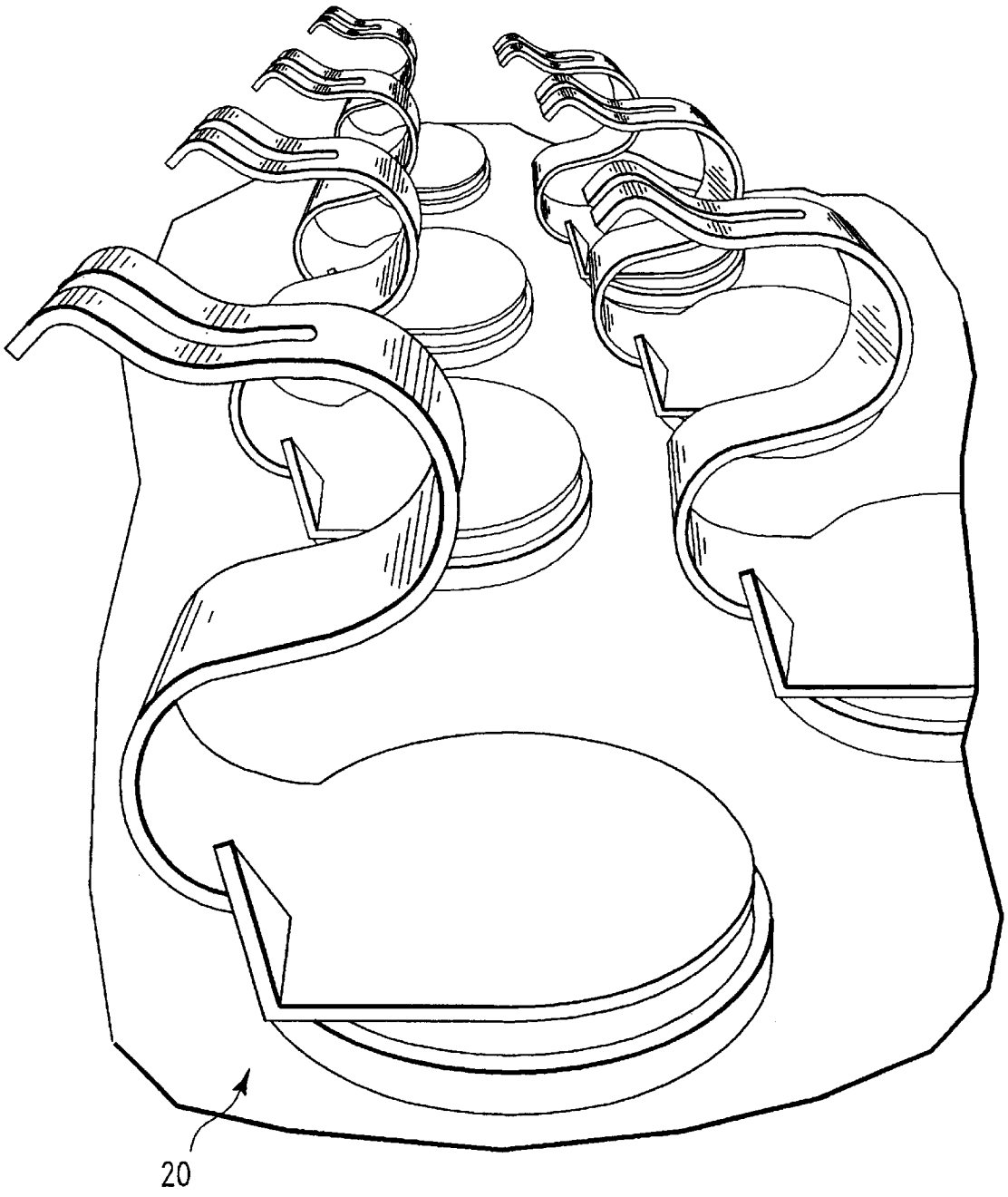
FIG. 5 is a perspective view of a second embodiment of the connectors joined to a substrate.

The general shape of connector 20 in one preferred embodiment of the present invention is C-shaped as shown in FIG. 4. In another preferred embodiment of the present invention, as shown in FIG. 5, the shape of the connector 20 can be S-shaped. The S-shaped connector, while somewhat more difficult to form, has an additional advantage in that it is more fatigue resistant than the C-shaped connector. Further, the compliance of the S-shaped connector is more directionally invariant.

Figure 6:
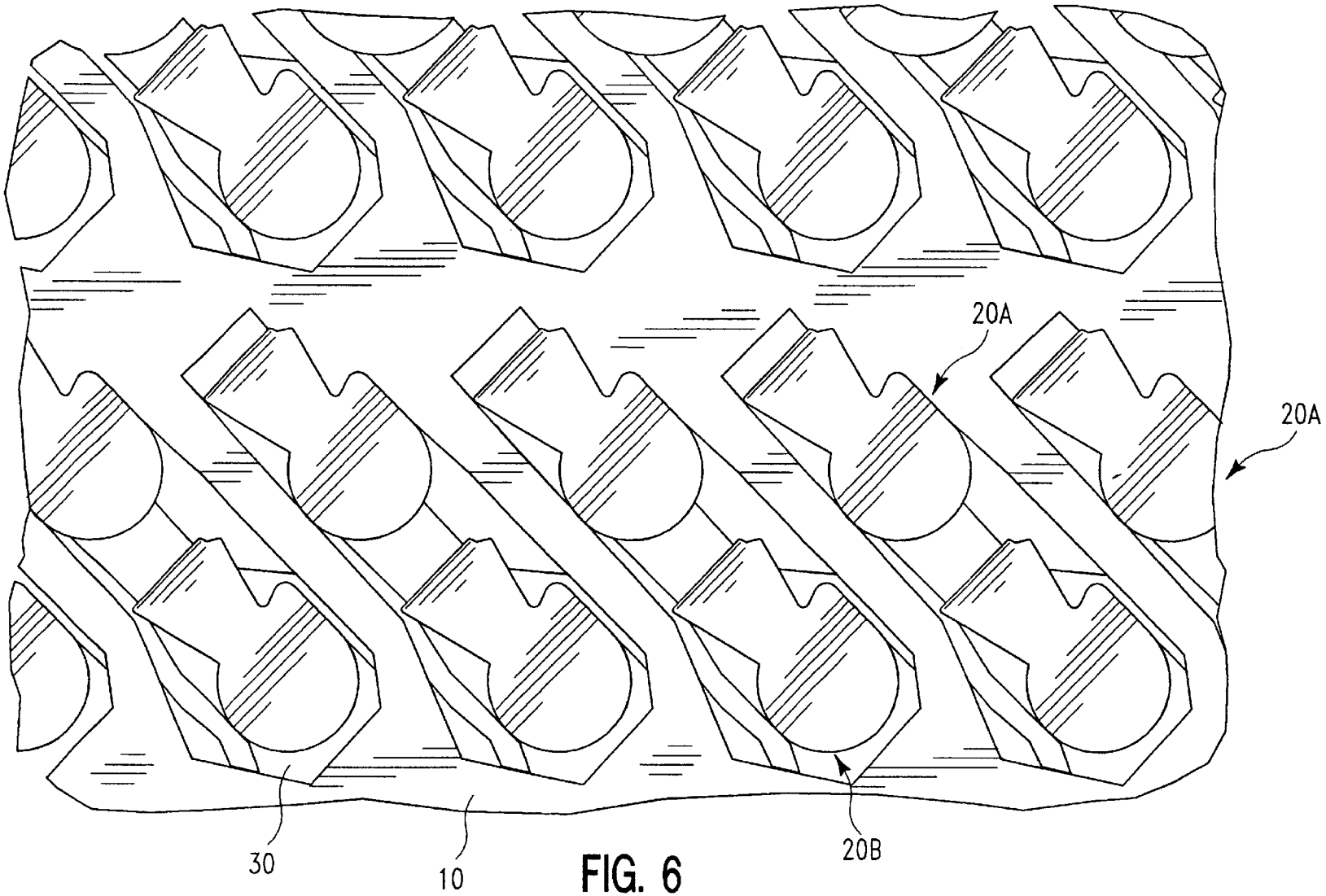
FIG. 6 is a view of alternative method of forming connectors wherein two sheets of connectors are placed together.

Referring back to FIG. 2, there are a plurality of perforations 30 in metallic sheet 10 where each of the connector blanks 12 used to be. Consequently, the distance between adjacent connectors 20 is limited by perforations 30. In a preferred embodiment of the present invention, two metallic sheets 10 each having connectors 20 formed therein can be interspersed together such that the connectors 20 from one metallic sheet 10 are located within perforations 30 of the adjacent metallic sheet 10. Referring now to FIG. 6, it can be seen that perforations 30 of metallic sheet 10 receive connectors 20B of an adjacent metallic sheet (not shown). In this manner, connectors 20B are adjacent to connectors 20A of metallic sheet 10, thereby increasing the density of the connectors. The forming of the connectors and joining of the connectors to a substrate for this preferred embodiment of the present invention are the same as that discussed previously.

Figure 7:
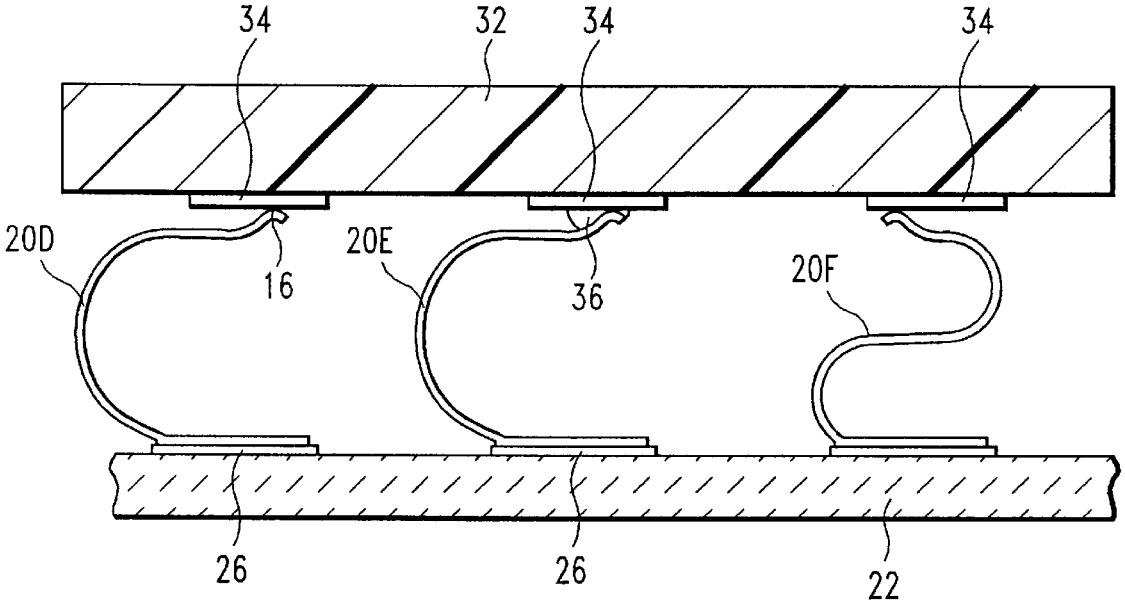
FIG. 7 is a partial cross sectional view showing the electrical connectors according to the present invention connecting two substrates.

Referring now to FIG. 7, there are shown connectors according to the present invention joined to a second substrate. As discussed previously, C-shaped connectors 20D, 20E and S-shaped connector 20F are joined to pads 26 on substrate 22, which is preferably a ceramic substrate as shown in FIG. 7 but could also be an organic substrate. Each of the connectors 20D, 20E, 20F makes contact with a pad 34 on a second substrate 32 which may be an organic substrate (e.g., fiberglass-filled epoxy) as shown in FIG. 7 or a ceramic substrate. C-shaped connector 20D and S-shaped connector 20F merely make a mechanical contact with pads 34. C-shaped connector 20E is soldered to pad 34. Substrates 22 and 32 are spaced apart such that the C-shaped connectors 20D, 20E and S-shaped connector 20F are placed in compression so that their respective contact portions 16 maintain adequate contact with pads 34.

It should be understood that FIG. 7 is for purposes of illustration only and there normally would not be a mix of soldered and unsoldered connectors and different shapes of connectors making contact between a single pair of substrates. Also, the wiring lines and vias normally present in electronic substrates such as that shown in the Figures, and particularly FIG. 7, are not shown for purposes of clarity. Similarly, semiconductor devices that would normally be present on substrate 22 or 32 are also not shown for clarity.

It will be apparent to those skilled in the art having regard to this disclosure that other modifications of this invention beyond those embodiments specifically described here may be made without departing from the spirit of the invention. Accordingly, such modifications are considered within the scope of the invention as limited solely by the appended claims.

What is claimed is:

1. A method of forming an electrical connector comprising:

providing a metallic sheet having a plurality of connector blanks formed therein, each of the connector blanks having a base portion, a contact portion and a singulation arm;

forming each of the connector blanks into a connector having a predetermined shape wherein each of the connectors remain connected to the metallic sheet by their respective singulation arms and wherein the singulation arms are nonplanar with respect to the metallic sheet;

joining the base of each of the connectors to a first substrate; and severing the singulation arms to separate each of the connectors from the metallic sheet wherein the base of each of the connectors is joined to the first substrate and the contact portion is adapted for contacting a second substrate.

2. The method of claim 1 wherein the step of severing includes repeatedly moving the metallic sheet in a direction parallel to a plane of the first substrate.

3. The method of claim 1 wherein the step of severing includes embrittling at least a portion of the singulation arms and exceeding the yield stress of the embrittled singulation arms.

4. The method of claim 1 wherein the predetermined shape is a C-shape.

5. The method of claim 1 wherein the predetermined shape is an S-shape.

6. The method of claim 1 wherein the metallic sheet is made of a material selected from the group consisting of copper, beryllium copper, brass, bronze, steel, nickel, titanium and nickel titanium alloys.

7. A method of forming an electrical connector comprising:

providing a first metallic sheet having a plurality of connector blanks formed therein, each of the connector blanks having a base portion, a contact portion and a singulation arm;

forming each of the connector blanks of the first metallic sheet into a connector having a predetermined shape wherein each of the connectors remain connected to the first metallic sheet by their respective singulation arms and wherein the singulation arms are nonplanar with respect to the metallic sheet, the metallic sheet having a perforation at least as large as the base portion of the connectors adjacent to each of the connectors;

providing a second metallic sheet having a plurality of connector blanks formed therein, each of the connector blanks having a base portion, a contact portion and a singulation arm;

forming each of the connector blanks of the second metallic sheet into a connector having a predetermined shape wherein each of the connectors remain connected to the second metallic sheet by their respective singulation arms and wherein the singulation arms are nonplanar with respect to the metallic sheet, the metallic sheet having a perforation at least as large as the base portion of the connectors adjacent to each of the connectors;

placing the first and second metallic sheets together so that each connector of one of the metallic sheets fits into the perforation adjacent to each of the connectors of the other of the metallic sheets;

joining the base of each of the connectors to a first substrate; and severing the singulation, arms to separate each of the connectors from the metallic sheet wherein the base of each of the connectors is joined to the first substrate and the contact portion is adapted for contacting a second substrate.

8. The method of claim 7 wherein the step of severing includes repeatedly moving the metallic sheet in a direction parallel to a plane of the first substrate.

9. The method of claim 7 wherein the step of severing includes embrittling at least a portion of the singulation arms and exceeding the yield stress of the embrittled singulation arms.

10. The method of claim 7 wherein the predetermined shape is a C-shape.

11. The method of claim 7 wherein the predetermined shape is an S-shape.

12. The method of claim 7 wherein the metallic sheet is made of a material selected from the group consisting of copper, beryllium copper, brass, bronze, steel, nickel, titanium and nickel titanium alloys.

13. A method of forming an electrical connector comprising:

providing a metallic sheet having a plurality of connector blanks formed therein, each of the connector blanks having a base portion, a contact portion and a singulation arm;

forming each of the connector blanks into a connector having a predetermined shape wherein each of the connectors remain connected to the metallic sheet by their respective singulation arms and wherein the singulation arms are nonplanar with respect to the metallic sheet;

joining the base of each of the connectors to a first substrate;

severing the singulation arms to separate each of the connectors from the metallic sheet wherein the base of each of the connectors is joined to the first substrate; and placing a second substrate adjacent to the first substrate so that each of the contact portions of the connectors contacts the second substrate.

14. The method of claim 13 wherein the step of severing includes repeatedly moving the metallic sheet in a direction parallel to a plane of the first substrate.

15. The method of claim 13 wherein the step of severing includes embrittling at least a portion of the singulation arms and exceeding the yield stress of the embrittled singulation arms.

16. The method of claim 13 wherein the predetermined shape is a C-shape.

17. The method of claim 13 wherein the predetermined shape is an S-shape.

18. The method of claim 13 wherein the metallic sheet is made of a material selected from the group consisting of copper, beryllium copper, brass, bronze, steel, nickel, titanium and nickel titanium alloys.

19. A method of forming an electrical connector comprising:

providing a first metallic sheet having a plurality of connector blanks formed therein, each of the connector blanks having a base portion, a contact portion and a singulation arm;

forming each of the connector blanks of the first metallic sheet into a connector having a predetermined shape wherein each of the connectors remain connected to the first metallic sheet by their respective singulation arms and wherein the singulation arms are nonplanar with respect to the metallic sheet, the metallic sheet having a perforation at least as large as the base portion of the connectors adjacent to each of the connectors;

providing a second metallic sheet having a plurality of connector blanks formed therein, each of the connector blanks having a base portion, a contact portion and a singulation arm;

forming each of the connector blanks of the second metallic sheet into a connector having a predetermined shape wherein each of the connectors remain connected to the second metallic sheet by their respective singulation arms and wherein the singulation arms are nonplanar with respect to the metallic sheet, the metallic sheet having a perforation at least as large as the base portion of the connectors adjacent to each of the connectors;

placing the first and second metallic sheets together so that each connector of one of the metallic sheets fits into the perforation adjacent to each of the other of the metallic sheets;

joining the base of each of the connectors to a first substrate;

severing the singulation arms to separate each of the connectors from the metallic sheet wherein the base of each of the connectors is joined to the first substrate; and placing a second substrate adjacent to the first substrate so that each of the contact portions of the connectors contacts the second substrate.

20. The method of claim 19 wherein the step of severing includes repeatedly moving the metallic sheet in a direction parallel to a plane of the first substrate.

21. The method of claim 19 wherein the step of severing includes embrittling at least a portion of the singulation arms and exceeding the yield stress of the embrittled singulation arms.

22. The method of claim 19 wherein the predetermined shape is a C-shape.

23. The method of claim 19 wherein the predetermined shape is an S-shape.

24. The method of claim 19 wherein the metallic sheet is made of a material selected from the group consisting of copper, beryllium copper, brass, bronze, steel, nickel, titanium and nickel titanium alloys.

* * * * *